United States Patent [19]

Tanson

[11] 4,254,941

[45] Mar. 10, 1981

[54] AUTOMATIC ANTI-FALL DEVICE FOR MANUAL OR MOTORIZED LIFTING SYSTEMS

[75] Inventor: Rodolphe Tanson, Moutfort, Luxembourg

[73] Assignee: Groupements d'Interets Economiques Europe-Levage-Manutention (ELMA), Bagnolet, France

[21] Appl. No.: 45,871

[22] Filed: Jun. 6, 1979

[51] Int. Cl.[3] ..... B66D 5/16

[52] U.S. Cl. ..... 254/267; 188/65.1; 188/188; 254/371

[58] Field of Search ..... 254/156, 157, 159, 173 R, 254/174; 187/89, 90, 91, 81, 82; 182/152; 188/65.1, 65.2, 65.3, 188

[56] References Cited

U.S. PATENT DOCUMENTS

| | | | |
|---|---|---|---|
| 3,669,223 | 6/1972 | Arnold | 188/188 |
| 3,968,865 | 7/1976 | McElroy | 188/188 |
| 3,968,865 | 7/1976 | McElroy | 254/156 |
| 3,980,161 | 9/1976 | Mouldin | 188/188 |
| 4,106,753 | 8/1978 | Cavalieri | 254/157 |

*Primary Examiner*—Edward J. McCarthy
*Attorney, Agent, or Firm*—John J. Dennemeyer

[57] ABSTRACT

The device is adapted to be used in a manual or motorized lifting system and comprises a self-tightening jaw-block which normally lets a lifting or an auxiliary cable pass through it, whereby a releasing device, by an excessive speed of the cable relatively to the jaw-block, lets jaws clamp the cable and an interrupter stop the motors.

10 Claims, 10 Drawing Figures

7
7'
52
5
51
E
02
A.L.
16a
16

AUTOMATIC ANTI-FALL DEVICE FOR MANUAL OR MOTORIZED LIFTING SYSTEMS

The main U.S. Pat. Ser. No. 4,106,733, concerns automatic cable safety apparatuses used in power-driven lifting systems in order to prevent for example the fall of a scaffolding nacelle, which comprise a cable clamping jaw block which is kept open under the action of the load applied to the lifting cable and/or the action of an engaging device, and which is adapted to grip an auxiliary cable when the action of the load is to be transferred from the lifting cable on to the safety cable either in connection with an interruption of this action of the load on the lifting cable or in the event that the speed of the jaw block sliding on the cable in a given direction exceeds a relative speed limit, whereby the apparatus according to the invention simultaneously shuts off the motor(s) of the lifting system. This apparatus actually makes it possible to realize the scopes of the main patent (chiefly a tightening of the jaw block combined with a shutting off of the motor(s) of the system either by a breaking of the lifting cable or in the event that the speed of the jaw block gliding on the cable in a given direction exceeds a limit speed), but may exclusively be employed when an auxiliary cable is available in order to take up the load, not only, of course, in case of rupture of the lifting cable, but also by breaking down, or failure, of the corresponding hoist.

Now, although employing an auxiliary cable is always advisable (in some countries even compulsory), it is of an obvious interest, in order to avoid being confronted with an alternative of "all or nothing", to dispose of an automatic anti-fall apparatus for motor lifting systems which is adapted to work, should an auxiliary cable fail, in cooperation with only one cable, whereby this cable may or may not simultaneously serve as lifting cable.

Besides, the apparatus according to the basic U.S. Pat. No. 4,106,733 is susceptible to be improved in connection with its reliability against an exceeding of said limit speed.

As a matter of fact, said apparatus improves, at least in relation with the automatic device releasing the self-tightening jaw block clamping the auxiliary cable, other apparatuses, having the same function, which comprise as well a conventional driving pulley running on the cable passing through the mechanism. In these other apparatuses the driving pulley is in fact so arranged that it causes a light deflection of the cable, but the cable groove arc along which the pulley leans against the cable—and consequently the pressure of the cable on the pulley and the adhesive force between cable and pulley—may decrease in an undetermined way owing e.g. to a swinging of the load; so that their releasing devices do not assuredly function by a linear speed of the cable (relatively to the driving pulley) being identical to the peripheral speed of the driving pulley, and as a consequence, the lowering speed of the load is not assuredly proportional to the angular speed of the inertia block (which is identical to the speed of the driving pulley). And in the absence of this proportionality there is no guarantee that a releasing of the cable clamping device will be effected exactly at the limit speed predetermined, and these devices, as well as the safety apparatuses which depend on them, may not be regarded as reliable as a safety apparatus should essentially be.

But if it is true that the apparatus according to the main U.S. Pat. No. 4,106,733 in an improvement on what was known—apart from other considerations, also because its reliability is not jeopardized by a swinging of the load, since the cable is pushed against a driving roller 26 (see FIG. 3) by a second roller 27—it is also true that the contact zone of the roller surface and of the cable surface—the latter being utterly uneven as it consists of spiral strands and strands of spiral steel wire—is practically represented by a line and does not assure constancy of friction between the cable and the roller 26 (which is to drive the releasing device of the cable clamping device). This is more especially true as this friction is likely to vary within very broad limits in relation, on the one hand, to the state of the cable surface, which may be lubricated or not, and then again, and above all, owing to the fact that it cannot be possibly prevented that the mechanism of the apparatus gets dirty, to a smaller or greater degree, even though it is enclosed in an absolutely tight case, because of dust, mud and the various (small) scraps normally present in a building site, as these foreign particles get lodged in the spiral grooves between adjacent strands and wires and are thus introduced into the apparatus by the cable itself.

This being the case, it is to be feared, actually only in the absence of those regular controls (comprising cleaning and greasing) which are prescribed, as a function of the working time (or also of the duration of inactivity), for all hoists and, a fortiori, for all safety apparatus, more particularly cable safety apparatus—that e.g. dust will mix with the lubricant and increase its viscosity, thus reducing more or less the speed of the roller driving the triggering device.

I—A second embodiment of the invention enables to obviate also these disadvantages by realising an apparatus adapted to perfectly perform its function under all working conditions. In this second improved embodiment, as hereafter described, are provided, together with means already employed in the first embodiment, several new means as they are set forth hereafter, respectively sub (a) and (b):

(a) 1. A cable clamping device with a pair of jaws exerting their action, started by a pretightening spring, on a cable going through the safety apparatus, wherein 1.1. either the jaws are reciprocally identical or one of them is U-shaped and comprises between its branches the other jaw, which is flat;

2. A releasing device of the cable clamping device, which allows the jaws to almost instantaneously come into contact with the cable, under the action of said pretightening spring, as soon as the critical speed is attained, wherein 2.1. at least one centrifugal inertia block rotates at an angular speed proportional to its longitudinal speed relatively to the cable passing through the safety apparatus, and is arranged in such a way that the centrifugal force developing therein displaces it radially so to bring about, through a system of links, a releasing of the self-tightening block;

3. A current interrupter, suited to break the circuit in the case of too great a lowering velocity depending or not on a wrong control from the operator;

(b) 1. A driving pulley actuating the releasing device, which consists of two symmetrical half-pulleys having a relatively great diameter and presenting each one half-groove fitting the contour of the cable, whereby these half-pulleys are pushed one against the other by several springs, and which rotates on a shaft provided with 1.1. a bearing, preferably a needle bearing, by means of which the shaft supporting the centrifugal inertia block under I—a.2.1. and the driving pulley under I—b.1 may turn with a very low friction;

2. A press sliding guide located parallel to the cable opposite the driving pulley under I—b.1 or else a press pulley (similar or not to pulley 27 of the basic U.S. Pat. No. 4,106,733 disposed in the same plane as the driving pulley, whereby the press element (guide or pulley) is provided with a semicircular groove having the same diameter as the cable and is urged by a spring toward the cable.

3. α. A coating material for the cable groove of the driving pulley under I-b.1, and, if desired, for the cable groove of the press pulley under I-b.2., which has a high coefficient of friction so that the driving pulley can turn without any rotative slipping between it and the cable;

β. A coating material for the cable groove of the press sliding guide under I-b.2. which has a low coefficient of friction and causes practically no power loss and no wear of the cable.

This second embodiment of the invention, in which are incorporated the improvements mentioned hereabove under I—b, is represented in the FIGS. 1—5 of the drawing.

Figure 1:
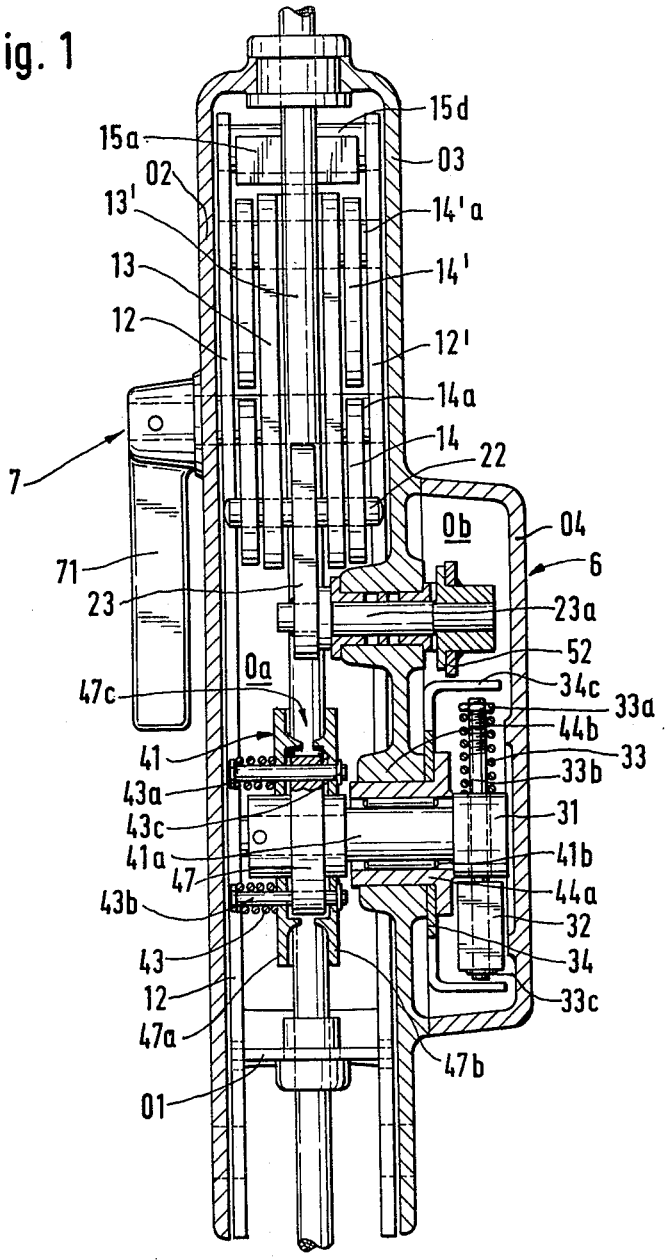
FIG. 1 is a longitudinal section of the apparatus along line I—I.
Figure 6:
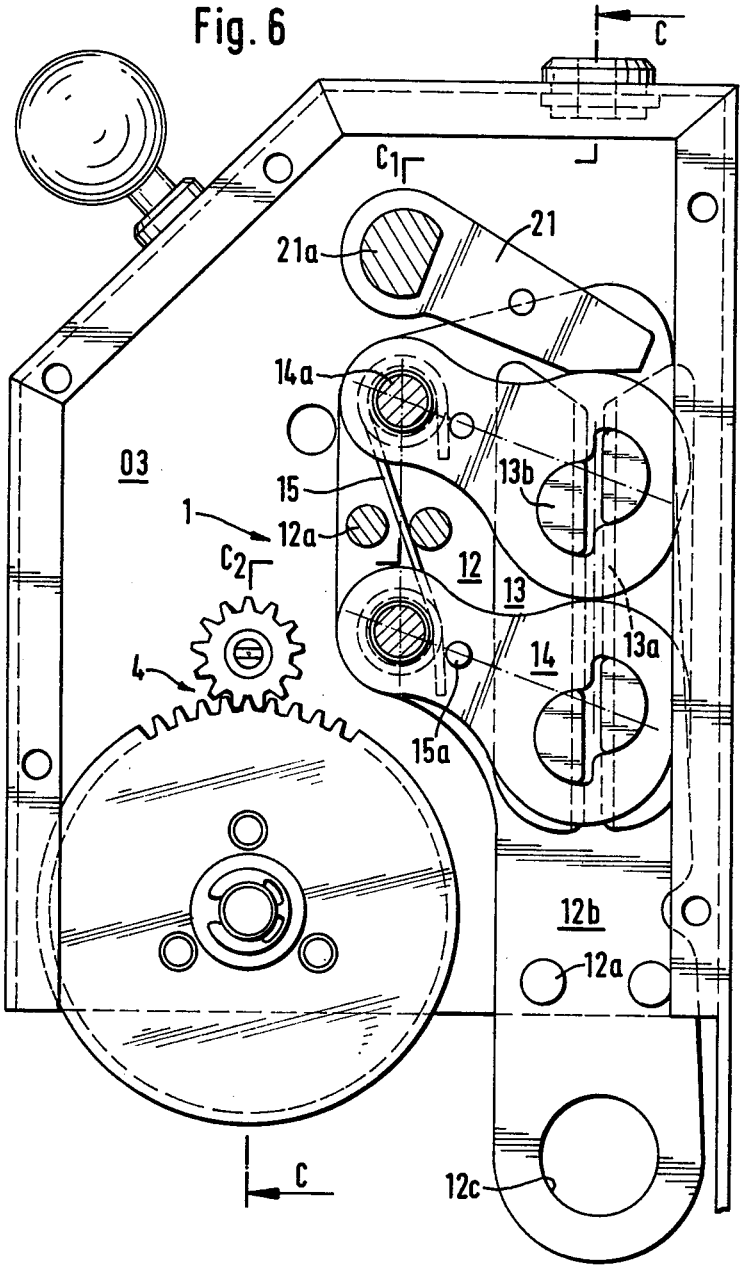
Figure 7:
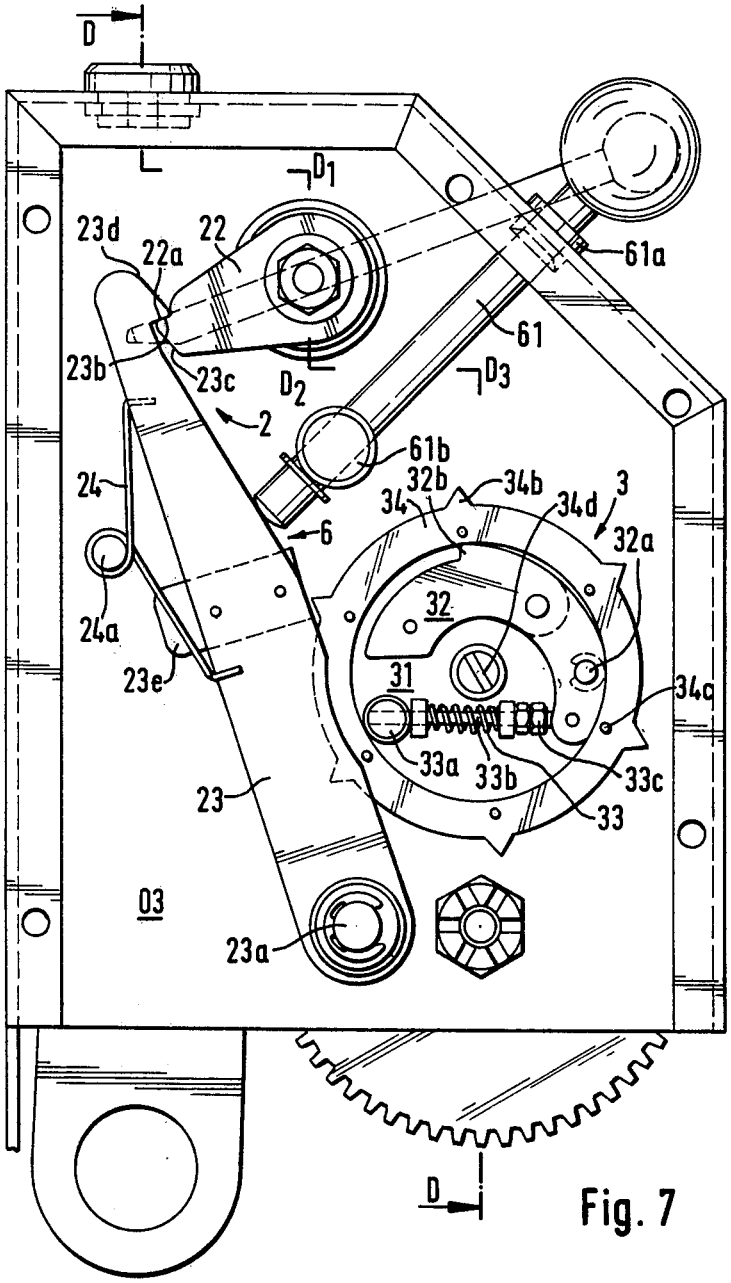
Figure 8:
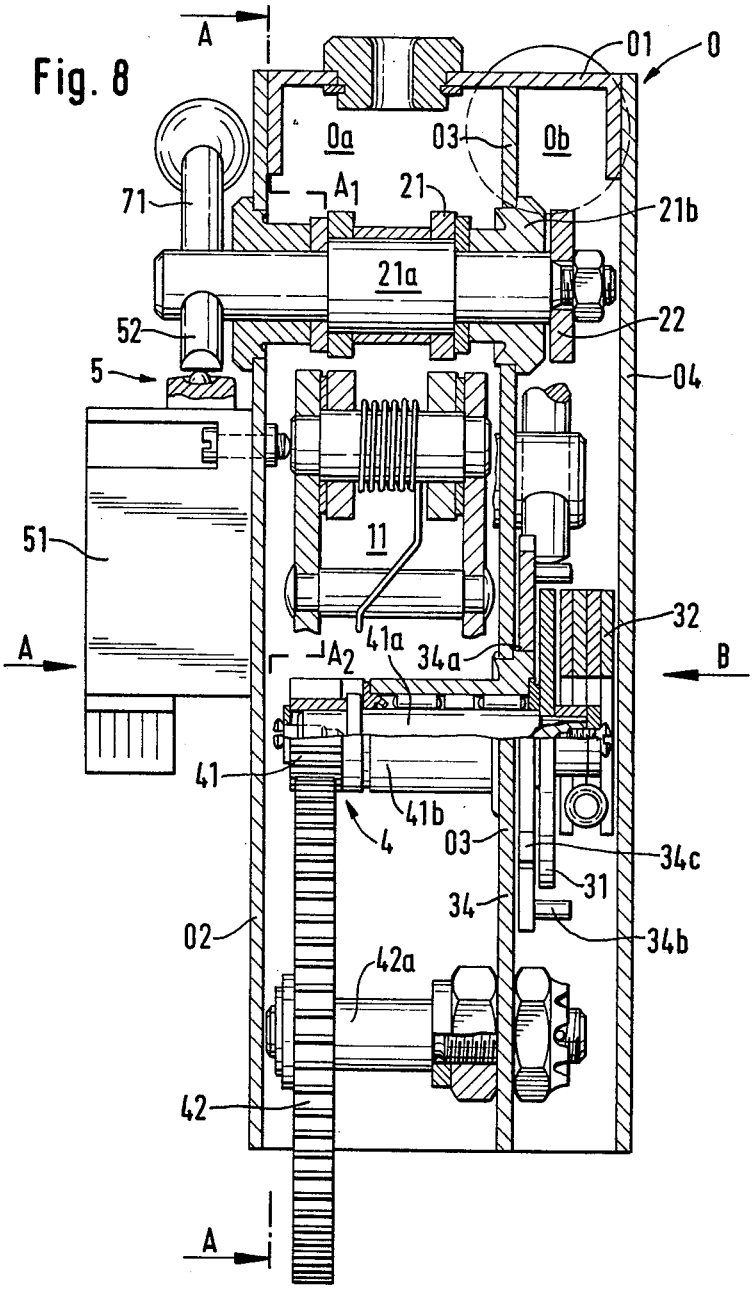
Figures 9, 10:
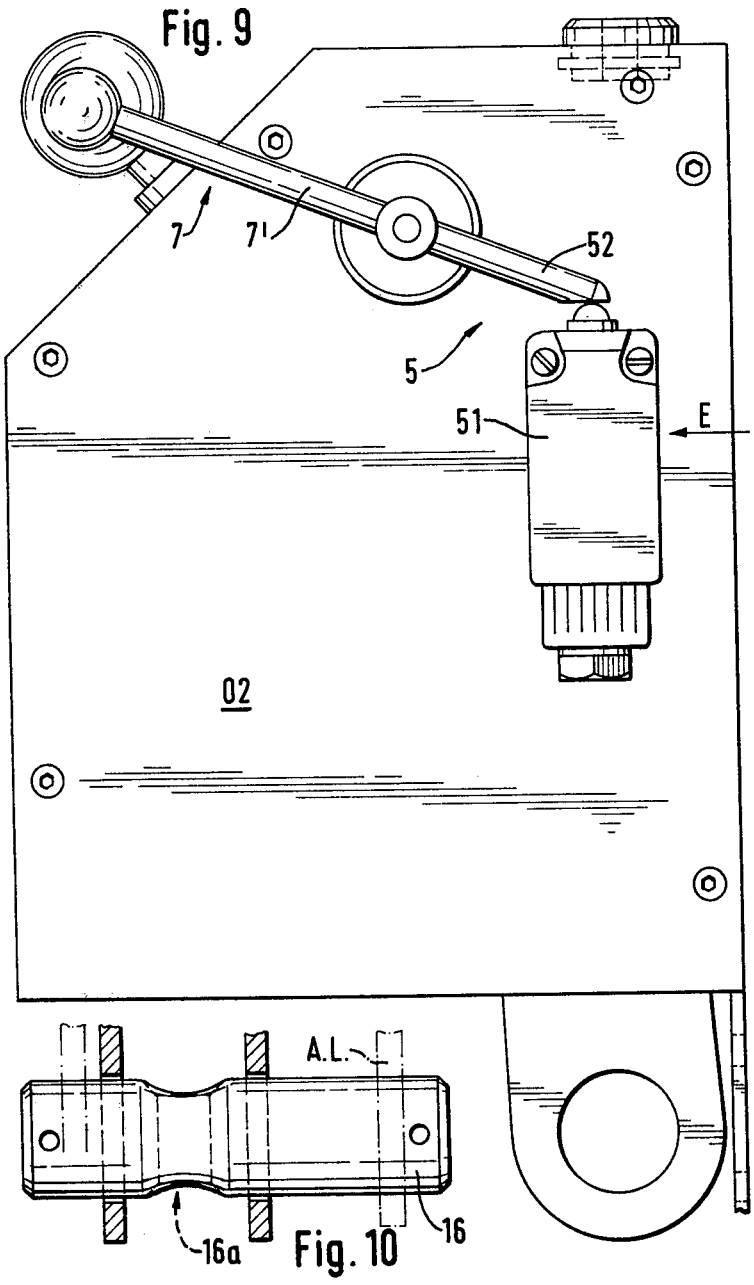

A third embodiment of the invention is represented in FIGS. 6–10 of the drawing, in which:

FIG. 6 is a section taken along the line A—A of FIG. 8;

FIG. 7 is an elevation view taken in the direction "B" of FIG. 8 in which the back plate 04 of casing 0 has been removed;

FIG. 8 is a cross sectional view taken on the line C—C of FIG. 6;

FIG. 9 is a front elevational view taken in the direction "A" of FIG. 8 of the device shown in FIGS. 6–8; and FIG. 10 is a fragmentary view, partly in section, of the pin 16 which connects the cable clamping device of the invention with the winch-hoist A.L.

The second embodiment as represented in FIGS. 1–5 of the drawing will now be described.

0. The safety apparatus is enclosed in a main case 0*a*, formed by two symmetrical case plates 02,03, and in a separate case 0*b*, defined by case plate 03 and by a case plate 04 secured to case plate 03 in a conventional way (e.g. by means of screws), and comprises the following devices:

a cable clamping device 1;

a stopping device 5 of the motor(s) actuating the hoisting and/or pulling system;

an engaging device 2 of the cable clamping device 1 and eventually of the motor(s) stopping device 5;

an automatic releasing device 3 of the cable clamping device 1 and eventually of the motor(s) stopping device 5;

a driving device 4 of the automatic releasing device 3;

a manual releasing device 6 of the cable clamping device 1 and eventually of the motor(s) stopping device 5;

a setting device 7 of the automatic releasing device 3.

1. The cable clamping device 1, which is located in the main case 0*a*, consists—as in the embodiment described in the basic patent—of a self-tightening block 11 composed by a pair of plates 12, 12' (of the self-tightening jaw block 11), a pair of cable clamping jaws 13, 13', two pairs of jaw actuating levers 14, 14', a jaw pretightening spring 15.

1.1. Plates 12, 12' are identical and reciprocally connected, e.g. by distance pins (riveted). They support at their upper part two shafts 14*a*, 14'*a* with which jaw actuating levers 14, 14' are pivotable.

Plates 12, 12' are linked up at their lower parts 12*b*, 12'*b* e.g. through two bolts or pins (not shown) lodged in holes 12*d* with the load and/or with the case (whereby, in the latter alternative, the case is connected with the load).

1.2. Cable clamping jaws 13, 13' are, also in this second improved embodiment of the safety apparatus, of the type employed in the embodiment described in the main U.S. Pat. No. 4,106,733 (that is of the 'U'-type).

The lower inside portion of the 'U'-jaw 13 and the lower side of the flat jaw 13'—which can penetrate more or less between the branches of the 'U'-jaw—have a semicircular section with the same diameter as the cable section and can clamp the cable on almost all its circumference.

1.3. Jaw actuating levers 14, 14' are two by two identical and are located opposite each other on both sides of the 'U'-jaw 13. They are solid with the two shafts 14*a*, 14'*a* which are pivotably connected to plates 12.

These levers are also solid with two elongated cross-cams 13*b*, which have a section composed of two equal semicircles reciprocally shifted on the common diameter whereon they are placed on opposite sides.

Cross-cams 13*b* pass through corresponding apertures 13*c* in the two jaws and their form is such that, when levers 14 pivot anti-clockwise (FIG. 2), jaws 13, 13' clamp the cable.

Levers 14 are provided with an extension 14*b* and to these extensions is pivotably connected a cross-piece 15*a*, which is under the thrust of jaw pretightening spring 15. Thus levers 14 tend to pivot with their shafts in the sense in which jaws 13, 13' draw together.

It may be pointed out, in this connection, that the shafts 14*a*, 14'*a* of jaw actuating levers 14 and the centers of the corresponding active portions of the apertures 14*b* in which cross-cams 13*b* are located, on the one hand, and the four centers of the semicircles of these apertures, on the other hand, form two articulate parallelograms, so that, while lever 14 and (consequently) lever 14' pivot under the action of pretightening spring 15 and/or of cable friction on jaws, the jaws remain rigorously parallel to one another and to the cable.

It may be pointed out as well that the sides of these parallelograms are arranged in such a way that the reaction of friction developed on the cable (FIG. 2, upwards), owing to the pretightening action of spring 15, when the clamping block 11 slides along the cable (downwards), tends to pivot the jaw tightening levers 14, 14' in the same direction as the pretightening spring.

An automatic clamping of the cable is thus assured, and the cable is gripped with a force which is proportional, under static conditions, to the weight of the load, and, under dynamic conditions, to the kinetic energy of the same.

1.4. Jaw pretightening spring 15 is wound around a bar 15*b*, which has, at one end, a U-piece 15*a* resting on a cross-bar 15*d* fixed on both side plates 12, 12', and passes, at the other end, through a hole in cross-piece 15*c*. Thus spring 15 is compressed between U-piece 15*a* and cross-piece 15*c* and exerts on the latter a thrust urging jaw actuating lever 14 to pivot in counter-clockwise direction (FIG. 2) and bring jaws 13, 13' together.

2. The engaging device 2 of cable clamping device 1 is composed of:

an engaging pawl 23 co-operating with an engaging cross-pin 22;

an engaging lever 52 actuated, by the intermediary of a link 21, by an engaging spring 24.

2.1. Engaging pawl 23 in order to cooperate with engaging cross-pin 22—which is secured to a second extension of jaw actuating levers 14 opposite the spring loaded first extension 14*b*—is located in the main case 0*a* together with the cable clamping device 1 and is solid with a shaft 23*a* pivotable in a bearing fixed to case plate 03.

Its free end is provided with a recess 23*b* wherein engaging cross-pin 22 is normally retained, and shaft 23*a* is so set that pawl 23 may move away from engaging cross-pin 22 in a direction parallel to the longitudinal axis of jaw actuating lever 14.

2.2. Engaging lever 52, link 21 and engaging spring 24 are enclosed in the separate case 0*b*. Engaging lever 52 is solid with shaft 23*a* of engaging pawl 23 while it is pivotably connected to link 21. This link is disposed in a direction generally perpendicular to the longitudinal axis of engaging lever 52 and its other end is under the action of engaging spring 24, which rests on a pin fastened to case plate 03. Thus engaging lever shaft 23*a* tends to pivot, according to FIG. 4, clockwise and engaging pawl 23 is maintained in a position where engaging cross-pin 22 rests in recess 23*b*.

3. The automatic device 3 releasing, in case of emergency, cable clamping device 1, is enclosed in the same case 0b as engaging device 2, which is completely separate from the main case 0*a* and is thus perfectly protected from foreign matters introduced into the safety apparatus by the cable itself. The automatic releasing device is composed of:

a hub 31 of automatic releasing device 3;

a centrifugal inertia block 32;

a balance spring 33 of centrifugal inertia block 32;

a releasing toothed wheel 34.

3.1. Hub 31 is keyed on a driving shaft 41*a*, with which it co-operates to trnsmit to the other members of the automatic releasing device the movement of rotation generated by the relative movement of translation between the cable and a driving member 41 in the form of a wheel fixed on driving shaft 41*a*.

3.2. Centrifugal inertia block 32 consists of a flat piece of metal having approximately the form of a sector. It is secured (e.g. by means of an elastic ring 33*c*) to a sliding rod 33*b* which goes through it in a radial direction and which can slide in a hole bored radially through hub 31 and shaft 41*a*.

3.3 The balance spring 33 of centrifugal inertia block 32 is wound around sliding rod 33*b* on the opposite side of the inertia block and rests on nut(s) 33*a* screwed on the rod. As the inertia block is normally maintained in contact with hub 31 with a force equal to the difference between the force of spring 33 and the centrifugal force, and starts to move away from the hub as soon as the centrifugal force overbalances spring 33, it is apparent that by screwing down more or less nuts(s) 33*a* and thus varying the force exerted by spring 33, the critical speed can accordingly be varied.

3.4. Releasing toothed wheet 34 is pivotably mounted on a (cylindrical) projection 44*a* of the shell of a needle bearing 41*b* of driving shaft 41*a* between the plate 03 of the main case 0*a* and a flange of the shell.

This releasing wheel is provided, in the case considered by way of example, with six equidistant radial teeth 34*c* which are bent at their free end in an axial direction, so that the internal side of their portions parallel to shaft 41*a* is close to the trajectory of the end of rod 33*b* which is on the side of the centrifugal inertia block 32.

Besides, this wheel 34 is provided with an extension 34*b* articulated to link 21 (which transmits the pull of engaging spring 24 to engaging lever 52).

4. The driving device 4 of the automatic releasing device 3 is composed of:

a driving member 41, a driving shaft 41*a*, a press sliding block (or a press roller) 45 with a press spring 46.

4.1. Driving member 41 consists mainly of a disc 47 and of two press rings 47*a*,47*b* enclosed in the main case 0*a*, in a same median plane with the cable clamping device. Disc 47 is solid with driving shaft 41*a* and is provided with several holes through which spring pins 43*b* may slide in an axial direction. Press rings 47*a*, 47*b* are similarly provided with holes allowing spring pins 43*b* to slide through freely, and bear each a half of a semicircular cable groove 47*c* arranged on their periphery.

It may be pointed out that the form of groove 47*c*, owing to the fact that the driving wheel 41 is halved whereby the halves are at an angle to one another, forms a semicircular groove with a slot, which notoriously has a driving coefficient more advantageous (almost three times as high) than a groove with a square section.

The press rings 47*a*, 47 *b* are pushed one against the other by compression springs 43 which are wound around spring pins 43*b* and exert their action on ring 47*a* directly and on ring 47*b* by the intermediary of the same spring pins 43*b*. Springs 43 are in fact compressed between ring 47*a* and a circlips or elastic washer 43*a* set at the near end of pin 43*b* so that a circlips 43*c* set at the far end of pin 43*b* pushes ring 47*b* towards ring 47*a* i.e. against the cable.

It may be observed that the pressure exerted on the cable can be modified, if desired, by substituting a nut for one, or for each, circlips, so as to compress springs 43 more or less.

4.2. The driving shaft 41*a*, whereon driving wheel 41 is keyed, as well as hub 31 (through which slides the rod 33*b* of the centrifugal inertia block 32), rotates in needle bearing 41*b* whose shell is lodged in a stiffened bracket 44*b* rigid with case plate 03, said bracket being rated for assuring a maximum rigidity.

4.3 Press sliding block 45 is located opposite to driving member 41 and is provided with a groove 45*c* having a curved profile and being set parallel to the cable, and with two oblong holes 45*b* perpendicular to the groove and slidingly connected to two guide pins 45*a*, fixed to plates 12, 12' of self-tightening block 11. The sliding block can thus be pushed against the cable by a spring (e.g. leaf spring 46) so that the cable is pressed between the block and the bottom of the cable groove formed by the halves arranged on the periphery of press rings 47*a*, 47*b* (as well as between the lateral portions of the cable groove of driving wheel 41 owing to the thrust of compression strings 43).

Instead of press sliding block 45 a press roller, not represented, may be employed, the axle of which is slidingly connected to two oblong holes, perpendicular to the cable, in plates 12, 12' of self-tightening block 11.)

5. Since also in this case the hoisting and/or pulling system is supposed to be actuated by one or more electric motors—although its driving could as well be effected either by any conventional motor (a hydraulic and/or pneumatic motor or an internal combustion engine etc.) or by hand —the device 5 for stopping the motor(s) consists of a circuit breaker 51, secured on the inside of case O*b*, and of an extension of the same level 52 which co-operates in engaging the cable clamping device 1. This extension, during a normal working of the hoisting system, exerts on a push-button of circuit breaker 51 a thrust which prevents it to cut off the current.

The circuit breaker should appropriately be of the two-stroke type, which lets current through only at every second stroke of the push-button.

6. A manual releasing device 6 of the cable clamping device 1 and of the motor(s) stopping device 5 can be easily provided in order to offer a supplementary safety in the event that a hoist and/or its electric motor would break down, e.g. at a certain lifting height, and the electro-magnetic brake would fail to work, or that the hoist would not firmly clamp the cable, but would let is slide through at a speed not high enough to trigger off the cable clamping device and motor(s) stopping device. Such a manual releasing device may simply consist of a releasing handly or lever (not shown in the drawing) rigidly mounted, outside of case O*b*, on an extension of the shaft 23*a* on which are fastened pawl 23 (engaging the cable clamping device 1) and lever 52 (engaging the motors stopping device 5).

Figure 2:
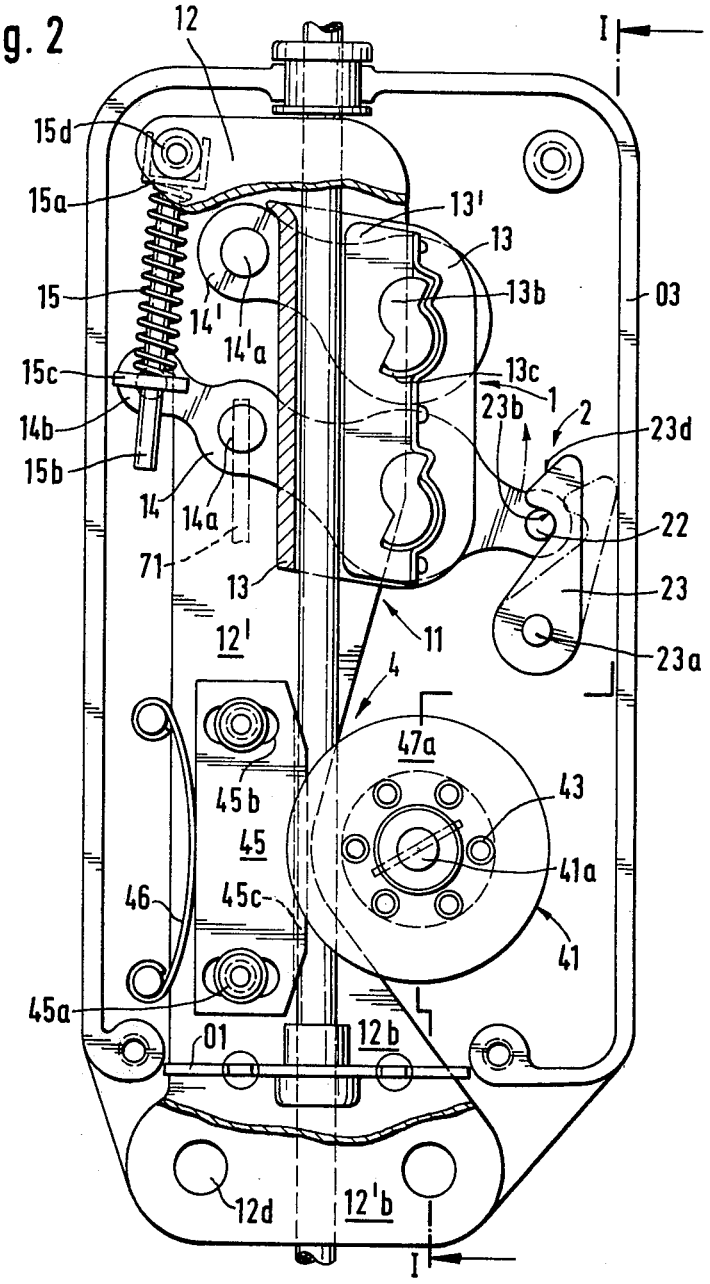
FIG. 2 is a front view, partly in section, of the apparatus after removal of the front case plates.
Figure 3:
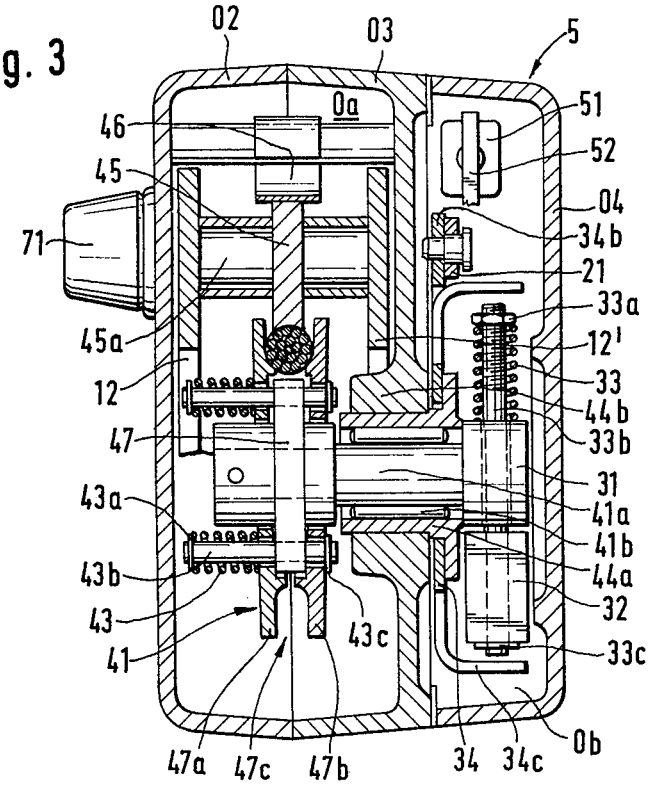
FIG. 3 is a cross-section along line III—III of FIG. 4.
Figure 5:
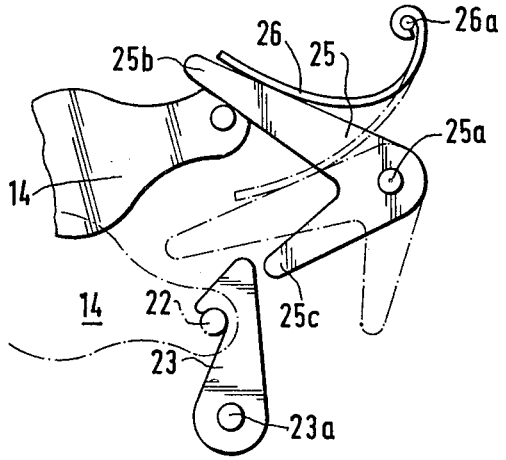
FIG. 5 is a view of a device preventing a manual (re)starting of motors while jaws 13, 13' clamp the cable.
Figure 4:
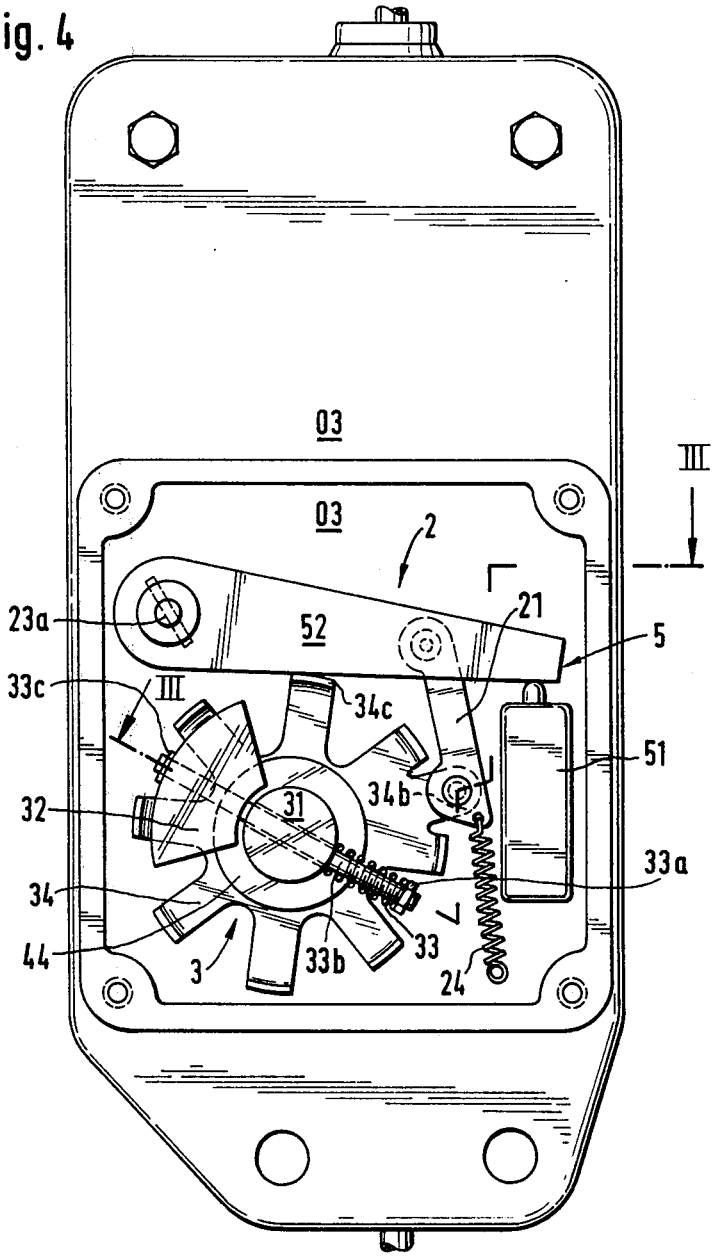
FIG. 4 is a back view after removal of the back case plate.

It is apparent that a rotation of shaft 23*a* (FIG. 2: clockwise; FIG. 4: anti-clockwise) will cause the engaging cross-pin 22 to get our of recess 23*b* of pawl 23, thus releasing cable clamping device 1, and will simultaneously lift lever 52 from the push-button of circuit-breaker 51, thus interrupting the feeding of the motor(s).

7. The setting device 7 of the automatic releasing device 3 of the cable champing device 1 and of the motor(s) stopping device 5 consists of a short flat setting lever 71 with a hub fixed, outside main case O*a*, to an extension of shaft 14*a* which is solid with jaw actuating lever 14. Lever 71 enables, against the action of jaw pretightening spring 15, to pivot lever 14 clockwise (FIG. 2), that is in the direction in which they loosen jaws 13, 13' and in which the extension of engaging lever 52 presses down the push-button of circuit breaker 51.

La—the working of the automatic safety apparatus described above does not substantially differ from the working of the first embodiment of the invention as disclosed in the main U.S. Pat. No. 4,106,733.

1. The mechanism of the apparatus, when ready to work, is in a (stable) equilibrium configuration as represented in the drawing (FIGS. 1–4), wherein engaging pawl 23 is pushed against engaging cross-pin 22 by engaging lever 52 controlled by engaging spring 24 through link 21. Jaw pretightening spring 15, which exerts a thrust on extension 14*b* of jaw actuating levers 14, is thus prevented from pivoting jaw actuating levers 14 in the direction where jaw 13, 13' draw closer together and grip the cable.

2. During a normal working of the hoisting and/or pulling system the above equilibrium configuration is not modified because, as long as the angular speed of driving shaft 41*a*, and of the system sliding rod 33*b*/centrifugal inertia block 32, is lower than the critical speed predetermined, the trajectory of the end of rod 33*b* adjacent to inertia block 32 does not intersect the inward (cylindrical) surface of the axial portion of the teeth of releasing wheel 34, and this wheel cannot trigger off, through the other members of releasing device 3, the cable clamping device 1 and the stopping device 5 of the motor(s).

3. At the very moment as, for a cause whatsoever, the (relative) up-speed of the cable and the angular speed of the system driving member 41 in the form of a wheel centrifugal inertia block 32 (FIG. 4: anti-clockwise)—these speeds being, owing to the invention, exactly proportional to one another—simultaneously exceed their respective critical values, the centrifugal force acting in inertia block 32 overbalances balance spring 33 so that the end of rod 33*b* which is adjacent to inertia block 32 is projected outwards and strikes against the one or the other axial portion 34*c* of releasing toothed wheel 34. This wheel is then bound to pivot sharply, thus causing, through the instrumentality of the members of the engaging device itself, engaging pawl 23 to pivot in the same direction (FIG. 2: clockwise) and to release engaging cross-pin 22. Thus jaw pretightening spring 15 is in a position to pivot jaw actuating levers 14 in the direction which corresponds to a reciprocal drawing nearer of cable clamping jaws 13, 13', and the friction developed on contact surfaces between jaws and cable rapidly increases up to the stopping, simultaneous and almost instantaneous, of cable clamping device 1, of the hoist and of the load hanging on the safety apparatus and/or the hoist. This stopping also coincides—in case of motor driven hoist(s) —with the stopping of the motor(s) because engaging lever 52, pivoting (FIG. 4: anti-clockwise) away from the automatic circuit breaker 51, lifts its free end from the push-button of same and does not prevent it any longer from switching off the current (or, generally: the feeding). Of course, lever 52 will thereafter be pulled back by engaging spring 24 to its precedent position where it presses down the push-button, but a current feeding will nevertheless not be restored, since the circuit breaker, as indicated hereabove, is opportunely of the two-stroke type. For normal operation of the hoisting and/or pulling system, the setting lever 71, as described hereabove sub 7, should be operated in order to again close and maintain closed the circuit (jaws 13, 13' being then again open). It is apparent, however, that the same result could be attained by operating, instead, the manual releasing lever or handle mounted on shaft 23*a*, which might cause serious damages to the lifting and/or pulling system because jaws 13, 13' would still be clamping the cable. The device shown in FIG. 5 prevents such an irregular operation.

It comprises a knee lever 25, pivoted on a pin 25*a* fixed (as engaging pawl 23) to case plate 03, and a spring 26 secured to a pin 26*a*, also fixed to case plate 03. The shape of knee lever 25 and the position of its pivot pin 25*a* are such that, when engaging pawl 23 normally engages cross-pin 22(dots-and-dashes configuration), the arms 25*b* and 25*c* remain idle on the one end on the other side of the free end of engaging pawl 23, while an automatic or manual releasing of jaw actuating levers 14 will cause arm 25*b* to turn (FIG. 5: clockwise) so that arm 25*c* gets to a position close by pawl 23 where it prevents it from pivoting away from cross-pin 22.

4. The setting of the automatic releasing device 3 of cable clamping device 1 and of the motor(s) stopping device 5 can be operated by means of setting lever 71 and of the same members of the engaging device 2 of cable clamping device 1.

Setting lever 71 (FIG. 2) by pivoting clockwise actually produces the following effects:

(a) jaw actuating levers 14, 14' also pivot clockwise (downwards) and move jaws apart;

(b) the end of engaging lever 52, drawn back by engaging spring 24, presses—in the case of an electrically driven hoist—the push-button of circuit breaker 51 and closes the circuit;

(c) knee lever 25 returns, under the action of spring 26 to its idle position;

(d) the engaging cross-pin 22 secured to the free end of jaw actuating levers 14, 14' also moves downwards and, sliding along a slanting surface 23*d* situated at the free end of engaging pawl 23, pushes this back (FIG. 2: dots-and-dashes line), against the thrust of engaging spring 24, until it is level with the recess 23*b* of the pawl. Thus this may be brought back to its initial position, owing to the pivoting motion that engaging spring 24 through link 21 imparts to engaging lever 52 and to shaft 23*a*, thus ratching the engaging cross-pin 22 and making inoperative the cable clamping block 11.

As jaws 13, 13' do not clamp any longer the cable, this may be now inserted or pulled out and, conversely, the safety apparatus may freely slide up and down the cable.

II—The purposes of the invention according to the main U.S. Pat. No. 4,106,733 are also achieved, in an even more efficient way, through a third embodiment which may particularly be employed when the safety apparatus is to co-operate with a winch-hoist provided with two two-part pulleys. (U.S. Pat. No. 4,193,311) This winch-hoist comprises, in a preferred embodiment, two pulleys similar to the driving member 41 serving in the apparatus described above as second, improved embodiment of the present invention to actuate the releasing device 3 of the cable clamping device 1. The pulleys, consisting each, as it will be recalled, of two co-axial parts (13), (14) pushed against one another by several springs (16), (U.S. Pat. No. 4,193,311), are coupled by means of two toothed rims arranged on their periphery beside the cable groove, and at least one of them is driven, e.g. by a greater motor.

In this third, improved embodiment of the invention the centrifugal releasing device is driven by a driving member 41 in the form of a sprocket which meshes—directly or through one or more cog-wheels 42—the peripheral toothed rim of at least one pulley of the winch-hoist. It appears that by this means the speed of the cable (and of the load), which is identical with that of the toothed rim, is—and cannot but remain—proportional to the angular speed of driving shaft 41*a* (carrying inertia block 32), thus excluding any irregularity in the transmission of the movement which might derive, not only (by insufficient maintenance) from foreign bodies penetrating into the case, but from any cause at all: an absolute reliablity of the automatic releasing device 3 and of the security apparatus itself is thereby warranted.

This third, improved embodiment of the invention is described hereafter:

1. The mechanism of the automatic security apparatus comprises the same devices as the mechanism of the second, improved embodiment of the invention, but the driving shaft 41*a* of the driving device 4 of the automatic releasing device 3 is now actuated by the sprocket and cog-wheel(s) above mentioned.

FIG. 6 shows in a section along line A1, A2 of FIG. 8.

the cable clamping device 1 and in a view from 'A' (the front plate 02 of casing 0 being removed)

the fram 01 of casing 0 and the driving gear 4 of automatic releasing device 3:, FIG. 7 is a view from 'B' of FIG. 8 (the back plate 04 of casing 0 being removed) of the engaging device 2 of the cable clamping and motor(s) stopping devices 1 5, respectively and of the automatic and manual releasing devices 3 resp. 6 of said cable clamping and motor(s) stopping devices 1 5 respectively;

FIG. 8 shows in a section-view along line $C_1C_2$ of FIG. 6 the cable clamping device 1, along line $C_2C$ of FIG. 6 the driving gear 4 of automatic releasing device 3, along line $D_1D_2D_3D$ of FIG. 7 the engaging device 2 of the cable clamping and motor(s) stopping device 1 5, respectively, and the automatic and manual releasing devices 3 6, respectively of said cable clamping and motor(s) stopping devices 1 5, respectively is and in a side view from 'E' of FIG. 9 the automatic motor(s) stopping device 5 and the setting device 7 of the automatic and manual releasing devices 3 6, respectively, of said cable clamping and motor(s) stopping device 1 5;

FIG. 9 is a front view from 'A' of FIG. 8 of the safety apparatus and, in particular, of the automatic motor(s) stopping device 5, and of the setting device 7 of the automatic and manual releasing device 3 6, respectively of said cable clamping device 1 and of motor(s) stopping device 5;

FIG. 10 shows the pin 16 connecting the cable clamping device 1 with the winch-hoist A. L.

O. A case O enclosing the mechanism comprises a frame 01, which may be secured (e.g. by means of bolts) to the case of hoist A. L., and a front plate 02, a partition plate 03 and a back plate 04, all secured (e.g. by means of screws) to frame 01 so to form two reciprocally tight half-cases O*a*, O*b*.

1. The cable clamping device 1, also consisting of a self-tightening block 11, is enclosed—with the driving gear 4 of the automatic releasing device 3—in half-case O*a* (FIGS. 6 and 8) and, though the cable clamping jaws are, by way of example, of a different type (which could have been employed as well in the second, improved embodiment of the invention, as described hereabove), also comprises a pair of plates 12 (of self-tightening jaw block ll, a pair of cable clamping jaws 13, two pairs of jaw actuating levers 14 and a jaw pretightening spring 15.

1.1 The two identical plates 12, rigidly connected through distance pins 12*a*, bear two fixed pins or two shafts 14*a* on which or, respectively, with which jaw actuating levers 14 are pivotable.

Each plate 12 is provided, on the load side, with an extension 12*b* having a bearing 12*c*, and in these bearings 12*c* a pin 16 is fixed with a cross-hole 16*a* set out in such a way that the cable may freely get through.

By mans of this pin the self-tightening block 11—when it is released either automatically by releasing device 3 or by the operator through the manual releasing device 6—takes up the load; that, again, either through the winch-hoist, if the load is attached to the case of said winch-hoist (whereby this is also secured, as seen above, to the frame 01 of the safety device), or directly if the load is attached immediately to pin 16 itself.

1.2 Cable clamping jaws 13 (which, as it has been mentioned hereabove, could also be similar to those employed in U.S. Pat. No. 4,106,733 as well as in the second, improved embodiment of the invention as described above, that is of a 'U'-type) are in the present variant of the type first disclosed in the U.S. Pat. No. 2,585,101. They are symmetrical and have two grooves 13*a* arranged in their opposite elongated surfaces along their longitudinal axis, which have a semicircular section susceptible to clamp the cable on almost all its circumference. Besides they are provided with two pairs of half-pins 13*b*, which are shifted from one another along their common diameter in a direction parallel to the longitudinal axis of the jaws and which project from their lateral surfaces so to engage with jaw actuating levers 14.

1.3. Jaw actuating levers 14, all mutually identical, are located on either side of jaws 13, on the inside of plates 12 (to which they are pivotably connected on pins or with shafts 14*a*), and show two appertures shaped and arranged in such a way that they allow a (limited) pivoting movement of half-pins 13*b* and thus—by a lowering movement of the security apparatus along the cable—cause jaws 13 to get close to one another and to clamp the cable with a force which is proportional to the kinetic energy of the load.

1.4. Jaw pretightening spring 15—in an even simpler way than in the second, improved embodiment of the invention disclosed above—is wound up around the pins (or shafts) 14*a* of the two pairs of jaw actuating levers 14 and its ends push each on a stud 15*a* fixed to one lever of each pair, in a direction which urges these levers to bring jaws 13 close together and onto the cable 2. The engaging device 2 of cable clamping device 1 is enclosed—with the releasing device 3 which drives it and except its engaging levers 21—in half-case O*b*. As this is completely separate—as stressed hereabove—from half-case O*a*, which encloses cable clamping device 1, engaging device 2 is perfectly sheltered from foreign bodies brought into the safety device by the cable itself.

This device is composed by a pair of engaging levers 21 of self-tightening block 11, an engaging ratched sector 22, an engaging pawl 23 and an engaging pawl spring 24, and is adapted to hold the engaging levers 21 of self-tightening block 11 (which are enclosed in the same half-case O*a* as the cable clamping device 1) in a position corresponding to unclamped jaws, and that against the thrust of jaw pretightening springs 15.

2.1. The engaging levers 21 of self-tightening block 11 are rigidly mounted on an engaging shaft 21*a*, which may pivot in two bearings 21*b* arranged respectively in the front case plate 02 and in partition plate 03.

In order to unclamp jaws 13, while ratching at the same time engaging ratchet sector 22, these levers may be actuated by the operator through a setting lever (or handle) 71 of the automatic device 3 for releasing the cable clamping and motor(s) stopping devices 1 5, respectively, whereby this lever 71 is fastened outside of case 0 on to the same engaging shaft 21*a*.

2.2. Engaging ratchet sector 22 is also solid with engaging shaft 21*a*, on the opposite side relatively to partition plate 03 as the engaging levers 21 of self-tightening block 11, and at the opposite end of engaging shaft 21*a* relative to setting lever 71.

Its function—by a normal working of the hoisting and/or pulling system—is to co-operate with engaging pawl 23 in preventing spring 15 from urging jaws 13 into contact with the cable, and for this purpose its free end has a tooth with a surface 22*a* situated in one plane with the ratchet sector axis.

2.3. Engaging pawl 23 consists of a very elongated piece, which is pivoted at one end on partition plate 03, whereby its other end has a nose with a surface 23*b*, perpendicular to the longitudinal axis of the pawl, on which may rest the corresponding surface 22*a* placed on the end tooth of ratchet sector 22.

On the median portion of pawl 23 is transversely secured, on its side in proximity of partition plate 03, a butting plate 23*e*, which co-operates with a releasing cam disc 34 (disclosed hereafter)—in case the load speed would exceed the maximum speed pre-established—for releasing ratchet sector 22.

2.4. Engaging pawl spring 24 has a median portion wound up around a pin 24*a* fixed at partition plate 03, two straight portions urging the back side of pawl 23 so that its nose remains in front of the tooth of ratchet sector 22, and two end portions bent transversely to either side of pawl 23 in order to keep it exactly in the same plane of ratchet sector 22, thus preventing an accidental releasing of the latter.

3. The automatic releasing device 3 of the cable clamping and motor(s) stopping devices 1 5, respectively, (which is also perfectly sheltered in half-case O*b*) is composed of a driving disc 31, a centrifugal inertia block 32, a balance spring 33 of inertia block 32 and a releasing cam disc 34.

3.1. The driving disc 31 is mounted at an end of the driving shaft 41*a*, which turns in a support 41*b* (preferably provided with a needle bearing) fixed on partition plate 03. At the periphery of this disc 31 is fixed a pin 32*a* on which centrifugal inertia block 32 may pivot (whereby the pivoting point is set near the back end of block 32), and, at a point almost diametrically opposed to pin 32*a*, a stud 33*a* transversely hole-bored on which rests balance spring 33 of inertia block 32.

3.2. Centrifugal inertia block 32 consists of several elongated plates, mutually superposed, and thus it is possible, by varying the number of these plates and simultaneously the compression rate of balance spring 33, to have the value of centrifugal speed changed in a wide range. These plates have a generally circular shape and their contour doesn't ever, at rest or by normal working, protrude beyond the contour of driving disc 31, so particularly not a nose 32*b* located approximately in the middle of the plates outer side.

Said plates are riveted together and are fixed to their pin 32*a* (located near their back end) e.g. through a circlips which can be set in the one or in the other of several transversal grooves of the pin.

3.3. The balance spring 33 of inertia block 32 is wound up on a pin 33*b* gliding in the transverse hole of stud 33*a* and being urged, by means of nuts 33*c* screwed at its free end, against the back end of the inertia block.

The force that nuts 33*c* exert on the back portion of inertia block 32 can thus be adjusted by more or less compressing balance spring 33 through nuts 33*c* in order to counterbalance the centrifugal force developed on the main (forward) portion of the inertia block, thus preventing nose 32*b* from projecting out the contour of driving disc 31 until the angular speed of the inertia block attains the value of the centrifugal speed as predetermined.

3.4. Releasing cam disc 34, which is located between partition plate 03 and driving disc 31, can pivot on a cylindrical extension 34*a* of the shell of the needle bearing 41*b* in which turns the driving shaft 41*a* rigidly supporting the driving disc 31.

Releasing disc 34 and driving disc 31 are therefore co-axial.

The releasing disc is provided, in the embodiment considered as an example, with six cams 34*b* as well as with six catches 34*c* disposed quite close to the contour of the driving disc (and corresponding each to one cam 34*b*). Then again, the position of the axis of releasing disc 34 is such that the (mutually coincident) trajectories of the ends of cams 34*b* are bound to be intersected by the salient edge of butting plate 23*c* of engaging pawl 23.

4. The driving gear 4 of automatic releasing device 3 is enclosed in the same half-case O*a* as cable clamping device 1 and comprises a driving member 41 in the form of a sprocket for actuating the driving disc 31;

a driving shaft 41*a;* an idle cog-wheel 42 and a shaft 42*a* of idle wheel 42.

4.1. Driving member 41 actuating the driving disc 31 is solid—for instance in the manner shown in FIG. 6 or else in another conventional manner—with the free end of the same driving shaft 41*a* with which is solid driving disc 31. This shaft 41*a* is pivotably connected with partition plate 03 by means of needle bearing 41*b* whose shell is fixed to the partition plate 03, so that a maximum rigidity is warranted.

4.2 & 3. Idle cog-wheel 42 meshes, on one side, driving member 41 and, on the other side, a toothed rim which is integral with the peripheral portion of the driving pulley of winch-hoist A. L., and turns, also by means of a bearing, on a shaft 42*a* which is fixed to partition plate 03 in a known manner, for instance as shown in FIG. 8. On one threaded end of shaft 42*a* are screwed, respectively on the one and the other side of the partition plate, a nut with washer and a castle-nut. Thus it is possible, by screwing both nuts tight, to rigidly fix shaft 42*a* to the partition plate and so to ensure its parallelism relatively to driving shaft 41*a*.

5. The stopping device 5 of the motor(s) actuating the hoisting and/or pulling system, that is, in the example considered, electric motor(s)—though driving could as well be effected, as in the embodiment of the invention disclosed above, by any type of motors or by hand—consists of a circuit breaker 51, secured e.g. on the outside of the case, on front plate 02, and of a lever 52 for engaging circuit breaker 51. This engaging lever is transversally fixed to the free end of engaging shaft 21*a*, on which also are rigidly mounted the engaging levers 21 of self-tightening block 11 and the engaging pawl 23 of the same, and its end, during a normal working of the hoisting and/or pulling plant, exerts on the push button of the circuit breaker a pressure which hinders it from automatically breaking the electric circuit. The admission of the interruption of the current feeding the motor(s) depends then on a voluntary operation of the respective push-buttons of an electric control switch board or switch hand-box.

6. The manual releasing device 6 of cable clamping device 1—which is intended to ensure (for example if the working platform should come to a standstill at a certain hoisting height) a supplementary safety besides the one offered by the electro-magnetic brake of the brake-motor—consists, in the embodiment shown in FIGS. 6 to 10, of a releasing rod 61 with handle.

This releasing rod is guided by a bush 61*a* fixed to the frame 01 of the case and passes through a hole-bored stud 61*b* fixed to partition plate 03. As the end of said rod is normally kept close by engaging pawl 23, a short forward movement of rod 61 lets pawl 23 pivot (FIG. 7: anti-clockwise) against the thrust of pawl spring 24. Instead of releasing rod 61 might be employed a releasing handle rigidly mounted on the pivot pin 23*a* of engaging pawl 23, whereby pawl 23 is then itself solid with pivot pin 23*a*.

II*a*—The working of this third, improved embodiment of the invention is substantially similar to the working of the second, improved embodiment of the same invention as previously disclosed:

1. The drawings (FIGS. 6 and 7) show the mechanism ready to work. Engaging pawl 23, controlled by pawl spring 24, co-opertes with engaging ratchet sector 22 and engaging levers 21 in preventing pretightening spring 15 from urging jaw actuating levers 14 to pivot in the direction in which jaws 13 are drawn closer together and clamp the cable.

2. The above equilibrium configuration remains unchanged as long as the hoisting and/or pulling plant works normally. The angular speed of driving disc 31 is then in fact lower, more or less, than the critical speed predetermined, and thus the forward position of inertia block 32, and in particular nose 32*b*, is held inside of the circumfernce of driving disc 31 by balance spring 33 (exerting a thrust on its back portion) and does not succeed to trigger off cable clamping device 1.

3. If the linear (down) speed of the load and the angular speed of the toothed rim of the driving pulley of winch-hoist A.L.—as well as the angular speed of driving disc 31 (FIG. 7: anti-clockwise), which is, in the present third embodiment of the invention, constantly proportional to the load speed—simultaneously exceed the respective critical values, the moment (relatively to pivoting pin 32*a*) of the centrifugal force acting on the forward portion of centrifugal inertia block 32 prevails over the moment of the force of balance spring 33 and projects said forward portion to the outside, so that the nose 32*b* on the outer side of the inertia block butts against the one or the other of the catches 34*c* which stand out of releasing cam disc 34.

One of the cams 34*b* of this disc then pushes back, against the action of pawl spring 24, the butting plate 23*e* of engaging pawl 23, and so the pawl itself, until the nose at the free end of the same disengages the surface 22*a* of the tooth of engaging ratchet sector 22. Thus pretightening spring 15 is in a condition to pivot jaw actuating levers 14 in the direction in which jaws 13 clamp the cable, and the friction force developing on the contact surfaces between jaws and cable rapidly increases up to the simulatneous, almost instantaneous stopping of cable clamping device 1 with the safety apparatus, of the winch-hoist (solid with the cable clamping device) and of the load hung thereon. This stopping coincides furthermore—in the case of a motor-driving—with the switching off of the motor(s). Jaw actuating levers 14, while pivoting (FIG. 6: upwards) under the action of pretightening spring 15, exert, in fact, a thrust on the engaging levers 21 of cable clamping device 1 and thus urge the engaging lever 52 of circuit breaker 51 (this lever being secured to the same engaging shaft 21*a* as engaging levers 21) in the direction in which said lever 52 is lifted from the push-button of the circuit breaker, thus allowing the current (or generally the fluid) to be automatically interrupted by the circuit breaker.

4. The automatic releasing device 3 of the cable clamping and motor(s) stopping devices 1 5, respectively can also be simply set by means of a setting device 7, consisting in the present embodiment of the invention of a setting lever 71 which is solid with the same engaging shaft 21*a* whereon is fixed the engaging lever 52 of circuit breaker 51. Said lever 71, while pivoting (FIG. 1: clockwise), produces in fact the following results:

(a) the engaging levers 21 of self-tightening block 11 (FIG. 6) also pivot clockwise (downwards) and, thus pivoting in the same direction jaw actuating levers 14, cause jaws 13 to move reciprocally apart;

(b) the free end of engaging lever 52 (FIG. 9) presses the push-button of circuit breaker 51 and closes the circuit;

(c) the engaging ratchet sector 22 (FIG. 7) pivots anti-clockwise and its cog, moving downwards, glides along a slanting surface 23*d* located at the free end of engaging pawl 23 and pushes this back, against the thrust of engaging spring 24, until the surface 22*a* of its cog gets on to a same plane with the corresponding surface of the nose of engaging pawl 23. This may then pivot, under the thrust of engaging spring 24, back to its initial position where it cogs ratchet sector 22 and consequently engages self-tightening block 11 through engaging levers 21, and circuit-breaker 51 through engaging lever 52.

The cable is thus free to pass through the apparatus and feeding may be controlled by means of the push-buttons of the switch-board or -handle.

It is obvious that the invention may not be limited to its embodiments as discovered and claimed, merely as examples, in the main U.S. Pat. No. 4,106,733 and in the present application for a patent of addition: various modifications of the devices described and claimed may be undertaken without passing the scope of the invention.

What we claim is:

1. Automatic safety apparatus adapted to working with a cable passing through it for stopping a load in the event of a breakdown of a motor driven and manual hoisting and pulling system, which comprises an automatic cable clamping device 1 consisting of a self-tightening jaw block (11) with two jaws (13), (13') located in the proximity of the cable, said jaws being constantly urged by a pair of spring driven levers (14), (14') to clamp the cable, whereby said jaw actuating levers are pivoted on two flanges (12), (12') parallel to the cable, which are connected with the load by means of a case O of the safety apparatus, as well as—in the case of a motor driven hoisting and pulling system an automatic motor(s) stopping device 5 comprising a circuit breaker 51 coupled with the cable clamping device 1, so that, while jaw block 11 is not prevented from clamping the cable, circuit breaker 51 interrupts feeding of the motor(s) driving the hoisting and pulling system, and which comprises besides, on the one hand, an engaging device 2 adapted to prevent working of said cable clamping device and of said eventual motor(s) stopping device as long as the relative speed of the safety apparatus and of the cable is lower than a pre-established critical speed, and, on the other hand, an automatic releasing device 3 of said automatic cable clamping device and of said eventual motor(s) stopping device, which is actuated by the centrifugal force developing in an inertia block 32 rotated by a driving member 41 of a driving device 4, whereby said driving member directly or indirectly receives itself a rotary motion from the cable, and which is adapted to neutralize the action of said engaging device as soon as the relative speed of the cable and of the safety apparatus attains said critical speed, and a manual releasing device 6 being adapted to neutralize the action of said engaging device independently from the relative speed of the cable and of the safety apparatus, characterized by the fact that said flanges 12, 12' to which the self-tightening block 11 is linked through its jaw actuating levers 14 are connected with the load directly and/or by means of a case of a hoisting and pulling apparatus A.L. so that the safety apparatus is adapted to work in order to stop the load either, by a breaking of the cable of the hoisting and pulling apparatus, on an auxiliary cable, or, by attaining said critical speed, as well on the cable of the hoisting and pulling apparatus as on an auxiliary cable.

2. Automatic safety apparatus according to claim 1 characterized by the fact that the engaging device 2 comprises an engaging pawl 23, articulated to the case O through a shaft 23*a*, which co-operates with an engaging member 22, and a setting lever 71, which can simultaneously cause, against the action of a jaw pretightening spring 15 and of an engaging lever spring 24, the jaw actuating levers 14 to pivot in the direction in which they urge jaws 13, 13' to move mutually apart, an engaging lever 52 to press push-button of the feeding interruper 51, thus closing the circuit, and the engaging member 22 to pivot back the engaging pawl 23, by acting on a slanting surface 23*d* of its free end, until the engaging member 22 gets caught in a recess 23*b* of the engaging pawl 23, so that the jaw actuating levers 14 and the engaging lever 52 respectively keep jaws 13, 13' unclamped and the feeding interrupter 51 inactive.

3. Automatic safety apparatus according to claim 2 characterized by the fact that the engaging member 22 rigidly interconnects the free ends of the jaw actuating levers 14, and that the engaging lever 52 of the motor(s) stopping device 5 is rigidly mounted on a same shaft 23*a* as the engaging pawl 23, and that the setting lever 71 is rigidly mounted on a same shaft 14*a* as the jaw actuating levers 14.

4. Automatic safety apparatus according to claim 2, wherein the jaw actuating levers 14 are pivotable in the direction in which jaws 13, 13' get mutually apart by means of a pair of engaging levers 21 of the cable clamping device 1 and that said engaging levers 21 are fastened on a same shaft 21*a* as the engaging lever 52 of the motor(s) stopping device 5, as the engaging member 22 and as the setting lever 71.

5. Safety apparatus according to claim 1 characterized by the fact that the inertia block 32 of the automatic releasing device 3, which can move in a radial direction whereby its position depends from the centrifugal force developing therein by rotation and from the force of an adjustable spring 33, pivots, by attaining said critical speed, a releasing wheel 34, having axially arranged projections 34*c*, until said wheel releases the engaging member 22 and thus permits, on the one hand, pretightening spring 15 to pivot jaw actuating levers 14 in the direction in which they urge jaws 13, 13' to grip the cable, and, on the other hand, interrupter 51 to cut motor feeding.

6. Automatic safety apparatus according to claim 1 characterized by the fact that the driving member 41 of automatic releasing device 3 consists of at least two co-axial wheel parts 47*a*, 47*b*, each provided with a cable groove part located on its peripheral edge, and by the fact that at least one of these wheel parts can move axially, owing to the action of one or several pressing members, towards another of said wheel parts and thus press on the cable.

7. Automatic safety apparatus according to claim 6 characterized by the fact that the cable is down in a cable groove 47*c* of driving member 41 by a pressing member 45, whereby said cable groove 47*c* consists of said cable groove parts located on the peripheral edges of said co-axial wheel parts 47*a*, 47*b* and whereby said pressing member is provided with a cable groove 45*c* and is laid along the cable in front of driving member 41 and is urged against the cable by a spring 46.

8. Automatic safety apparatus according to claim 1 characterized by the fact that the driving wheel 41 is solid with a shaft 41*a* which is pivotably connected, preferably through needle bearings, with the case O and which receives a rotary motion from the hoisting and pulling system through a gearing 4.

9. Automatic safety apparatus according to claim 2 characterized by the fact that the manual releasing device 6 permits to release engaging member 22 either through a releasing rod 61 arranged transversely to engaging pawl 23, or through a releasing handle mounted on shaft 23*a* of pawl 23.

10. Automatic safety apparatus according to claim 1 wherein the driving device 4 takes the form of gearing 4 and characterized by the fact that the self-tightening block 11, the engaging levers 21 of the self-tightening block 11 and the gearing 4 actuating the releasing device 3 of engaging device 2, on the one hand, and engaging member 22, engaging pawl 23 and the automatic and manual releasing devices 3, 6, respectively, of cable clamping device 1 are separately enclosed in the one and, respectively, in the other of two half-cases O*a*, O*b* of the housing O of the safety apparatus.

* * * * *